US012203274B2

(12) United States Patent
De Rick

(10) Patent No.: US 12,203,274 B2
(45) Date of Patent: Jan. 21, 2025

(54) FLOOR PANEL FOR FORMING A FLOOR COVERING

(71) Applicant: FLOORING INDUSTRIES LIMITED, SARL, Bertrange (LU)

(72) Inventor: Jan De Rick, Geraardsbergen (BE)

(73) Assignee: UNILIN BV, Wielsbeke (BE)

( * ) Notice: Subject to any disclaimer, the term of this patent is extended or adjusted under 35 U.S.C. 154(b) by 205 days.

(21) Appl. No.: 17/781,997

(22) PCT Filed: Nov. 3, 2020

(86) PCT No.: PCT/IB2020/060310

§ 371 (c)(1),
(2) Date: Jun. 2, 2022

(87) PCT Pub. No.: WO2021/111210

PCT Pub. Date: Jun. 10, 2021

(65) Prior Publication Data

US 2023/0003034 A1 Jan. 5, 2023

Related U.S. Application Data

(60) Provisional application No. 62/976,504, filed on Feb. 14, 2020, provisional application No. 62/942,861, filed on Dec. 3, 2019.

(51) Int. Cl.
*E04F 15/00* (2006.01)
*E04F 15/02* (2006.01)

(52) U.S. Cl.
CPC *E04F 15/02038* (2013.01); *E04F 2201/0146* (2013.01); *E04F 2201/0153* (2013.01);
(Continued)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 9,695,851 B2 7/2017 Hannig
10,190,611 B2 1/2019 Hannig
(Continued)

FOREIGN PATENT DOCUMENTS

CN 103477004 A 12/2013
CN 110431276 A 11/2019
(Continued)

OTHER PUBLICATIONS

International Search Report from PCT Application No. PCT/IB2020/060310, Mar. 2, 2021.

*Primary Examiner* — Chi Q Nguyen
(74) *Attorney, Agent, or Firm* — Workman Nydegger

(57) ABSTRACT

A floor panel for forming a floor covering, such that the floor covering includes floor panels, which, on at least one pair of edges, are provided with coupling parts. The coupling parts are substantially manufactured from the material of the floor panel. The coupling parts are configured such that two floor panels, at the pair of edges, can be installed and locked to each other by a downward movement and/or by using a fold-down principle.

20 Claims, 8 Drawing Sheets

(52) U.S. Cl.
CPC ... *E04F 2201/023* (2013.01); *E04F 2201/042* (2013.01); *E04F 2201/043* (2013.01)

(58) Field of Classification Search
CPC ..... E04F 2201/0107; E04F 2201/03; E04F 15/105; E04F 2201/0115; E04F 2201/0153; E04F 2201/0552; E04F 2201/023; E04F 2201/0535; E04F 2201/0146; E04F 2201/043; E04F 2201/0547; E04F 2201/0138; B32B 2471/00
See application file for complete search history.

(56) References Cited

U.S. PATENT DOCUMENTS

| | | | | |
|---|---|---|---|---|
| 10,697,184 | B2 * | 6/2020 | De Rick | E04F 15/02038 |
| 11,053,693 | B2 * | 7/2021 | De Rick | E04F 15/02038 |
| 11,072,929 | B2 * | 7/2021 | De Rick | E04F 13/0894 |
| 11,208,814 | B2 * | 12/2021 | De Rick | E04F 15/10 |
| 11,525,268 | B2 * | 12/2022 | De Rick | B32B 27/304 |
| 11,739,538 | B2 * | 8/2023 | De Rick | E04F 15/02038 52/588.1 |
| 11,788,300 | B2 * | 10/2023 | De Rick | E04F 13/0832 52/506.05 |
| 11,834,843 | B2 * | 12/2023 | Schacht | B32B 27/304 |
| 11,858,165 | B2 * | 1/2024 | De Rick | B27F 1/02 |
| 2004/0250492 | A1 * | 12/2004 | Becker | E04F 15/04 52/578 |
| 2013/0104485 | A1 * | 5/2013 | Meersseman | B27N 7/00 428/53 |
| 2013/0276398 | A1 | 10/2013 | Hannig | |
| 2013/0309441 | A1 | 11/2013 | Hannig | |
| 2015/0267418 | A1 | 9/2015 | Vermeulen et al. | |
| 2016/0177577 | A1 * | 6/2016 | Cappelle | B65D 85/62 52/582.2 |
| 2017/0241136 | A1 | 8/2017 | Kell | |
| 2017/0268545 | A1 | 9/2017 | Hannig | |
| 2020/0277796 | A1 | 9/2020 | De Rick | |
| 2021/0030303 | A1 * | 2/2021 | Gärber | A61B 5/7246 |

FOREIGN PATENT DOCUMENTS

| | | | |
|---|---|---|---|
| DE | 10224540 | A1 | 12/2003 |
| DE | 10242647 | A1 | 6/2004 |
| WO | 2012101171 | A1 | 8/2012 |
| WO | 2017068523 | A1 | 4/2017 |
| WO | 2017115202 | A1 | 7/2017 |
| WO | 2018172955 | A2 | 9/2018 |
| WO | 2019082141 | A1 | 5/2019 |
| WO | 2019137964 | A1 | 7/2019 |
| WO | 2020234711 | A1 | 11/2020 |

* cited by examiner

FLOOR PANEL FOR FORMING A FLOOR COVERING

BACKGROUND

This invention relates to a floor panel for forming a floor covering, more particularly for forming a floor covering which can be installed on an underlying surface. More particularly, the invention relates to floor panels which can be coupled to each other by means of mechanical coupling parts.

The aim of the invention is that a floor covering of such floor panels can be installed easily, however, that simultaneously also sufficient strength is obtained in the floor covering, more particularly sufficiently strong connections can be realized among the floor panels, such in combination with production techniques which keep the production costs limited.

Primarily, the invention relates to floor panels which can be installed by means of the so-called fold-down technique, such in order to be able to fulfill the targeted requirement of a simple installation. A fact herein is that two of the edges, in the case of oblong floor panels mostly the short edges, must be able to be joined to each other by means of a downward movement, bringing about a vertical locking. A good vertical locking can be realized by means of separate elastic locking strips. An example of such approach is disclosed in WO2017/068523.

However, realizing and providing the separate elastic locking strips is expensive. In order to exclude these costs, one-piece or substantially one-piece coupling profiles can be used for the edges of floor panels to be joined by a downward movement thereby creating a vertical locking. Such approach is disclosed in WO2017/115202, WO2018/172955, WO2019/137964, WO2019/082141, US2015/0267418A1, US2013/0276398A1 and US2017/0241136A1. However, it is known that such coupling parts realized in one piece mostly offer a less stable connection; either the connection is too taut and the floor panels cannot be joined to each other or can only be joined together by damaging them, or the coupling offers too little resistance against unlocking. It seems that the quality of the coupling is extremely dependent on configuration details and applied materials.

SUMMARY

It is an objective of this invention to provide coupling parts that allow coupling edges of a floor panel by means of a downward movement wherein a vertical locking is provided between the coupled edges that show one or more improvements over the prior art.

The present invention specifically provides floor panels with coupling parts that are easier to produce; and that allow coupling edges of a floor panel by means of a downward movement whereby a vertical locking is provided between the coupled edges. More specifically, the present invention provides floor panels that can be installed by means of the fold-down technique, that can be produced more easily and wherein the installed floor panels can be un-installed by means of a turning movement. This un-installing—involving unlocking—can be required when errors have been made during installation of the floor panel. This unlocking is also required when the floor panels are removed in order to install them in another room, e.g. when moving from one house to another house. This unlocking is also required when a floor panel is damaged and replacement of the damaged floor panel by another floor panel is envisaged.

The invention is a floor panel for forming a floor covering. The floor panel comprises a first pair of opposite edges, as well as a second pair of opposite edges. The first pair of opposite edges comprises coupling parts, which allow that two of such floor panels mutually can be coupled to each other. The coupling parts of the first pair of opposite edges show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts substantially are realized from the material of the floor panel itself. The second pair of opposite edges also comprises coupling parts on both edges, which allow that two of such floor panels mutually can be coupled to each other.

The coupling parts at the second pair of opposite edges show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts substantially are realized from the material of the floor panel itself.

The horizontally active locking system of the second pair of edges is formed at least of an upward-directed lower hook-shaped part which is situated on one of said two edges, as well as a downward-directed upper hook-shaped part, which is situated on the opposite edge. The upward-directed lower hook-shaped part consists of a lip with an upward-directed locking element, which proximally thereof defines a female part in the form of a recess. The downward-directed upper hook-shaped part consists of a lip with a downward-directed locking element forming a male part. The coupling parts of the second pair of opposing edges are configured such that two of such floor panels can be coupled to each other at their respective edges by means of a downward movement—preferably involving a downward snapping movement—of the one floor panel in respect to the other. The vertically active locking system of the second pair of opposing edges comprises vertically active locking parts, which, by means of respective locking surfaces, define at least a first vertical locking zone and a second vertical locking zone. In coupled condition of two such panels the first vertical locking zone is located at the distal end of the upward-directed locking element. In coupled condition of two such panels the second vertical locking zone is situated at the distal end of the downward-directed locking element. The aforementioned vertically active locking parts comprise a first locking part at the edge of the panel at the proximal end of the lip of the upper hook-shaped part, a second locking part at the distal end of the downward-directed locking element, as well as a third locking part at the distal end of the lip of the lower hook-shaped part and a fourth locking part at the proximal end of the female part. The first and the third locking part, in the coupled condition of two of such floor panels, define the first vertical locking zone; The second and the fourth locking part, in the coupled condition of two of such floor panels, define the second vertical locking zone.

Floor panels according to the invention can be installed more easily as less force is required when coupling the floor panels to each other.

Furthermore, the invention creates that installed floor panels can be uninstalled in an easy way. E.g. by unlocking and removing—by means of a turning movement—a row of panels; and then again by turning movements, removing the individual floor panels from the removed row of panels. This is made possible by the configuration of the coupling parts at the second pair of opposite edges.

Preferably, in coupled condition at the second pair of edges of two such floor panels, no vertical locking is provided between the proximal end of the downward-directed locking element and the proximal end of the upward-directed locking element. Such embodiments facilitate the coupling of the floor panels, meaning that less force is required to couple floor panels at the second pair of edges when installing such floor panels. Furthermore, floor panels according to such embodiments can be more easily uncoupled from installed floor coverings.

Preferably, the floor panel is configured such that the first vertical locking zone and the second vertical locking zone are the only zones where a vertical locking is provided in coupled condition of two such floor panels between the edges of their second pair of opposite edges. Such embodiments facilitate the coupling of the floor panels, meaning that less force is required to couple floor panels at the second pair of edges when installing such floor panels. Furthermore, floor panels according to such embodiments can be more easily uncoupled from installed floor coverings.

Preferably, the first vertical locking zone is provided at least at ⅔ of the thickness of the floor panel from the surface of the floor panel.

Preferably, the angle between the proximal end of the downward-directed locking element and the horizontal direction in the proximal direction of the upper hook-shaped part is less than 90°, preferably less than 80°, preferably more than 60°, e.g. 75° or e.g. 86°. The angle relevant for this preferred embodiment is the angle at the middle of the proximal end of the downward-directed locking element.

Preferably, the angle between the proximal end of the upward-directed locking element and the horizontal direction in the distal direction of the lower hook-shaped part is less than 90°, preferably less than 80°, preferably more than 60°, e.g. 75°. The angle relevant for this preferred embodiment is the angle at the middle of the proximal end of the upward-directed locking element.

Preferably, in coupled condition at the second pair of edges of two such floor panels, the proximal end of the downward-directed locking element contacts the proximal end of the upward-directed locking element. More preferably, the angle of the contact between the proximal end of the downward-directed locking element and the proximal end of the upward-directed locking element, and the horizontal direction in the direction towards the distal end of the upward-directed locking element is less than 90°, preferably less than 80°, preferably more than 60°, e.g. 75°. The angle to be observed for such embodiments it at the middle of the contact between the proximal end of the downward-directed locking element and the proximal end of the upward-directed locking element.

Preferably, in coupled condition at the second pair of opposite edges of two such floor panels, the proximal end of the downward-directed locking element contacts the proximal end of the upward-directed locking element with pretension. Such pretension can be created when there is an overlap of the downward-directed locking element and the upward-directed locking element, such that when coupling two such floor panels, the one locking element has to push away the other locking element. More preferably, this results in an elastic bending—creating the pretension—of the lip with the upward-directed locking element.

In an alternative preferred embodiment, in coupled condition at the second pair of edges of two such floor panels, the proximal end of the downward-directed locking element contacts the proximal end of the upward-directed locking element without pretension.

In preferred floor panels, the second locking part is provided by a first undercut at the distal end of the downward-directed locking element. The fourth locking part is provided by a first protrusion at the proximal end of the female part. More preferably, in coupled condition of two such floor panels at the second pair of opposite edges, the bottom of the first undercut contacts the bottom of the first protrusion.

In preferred embodiments, the included angle of the first protrusion is larger than the included angle of the first undercut. The difference is preferably more than 5°.

Preferably, the first undercut has a triangular shape with rounded corner points.

Preferably, the first protrusion comprises two inclined outer surfaces with in between the two inclined outer surfaces a vertical surface. More preferably the upper inclined surface is more inclined with respect to the surface of the floor panel than the lower inclined surface.

Preferably, the bottom of the first protrusion has an angle between 25° and 35° with the surface of the floor panel.

Preferably, the bottom of the first undercut has an angle between 25° and 35° with the surface of the floor panel.

Preferably, the bottom of the first protrusion has an angle less than 10°, and more preferably less than 5°, with the surface of the floor panel. Even more preferably, the bottom of the first protrusion is parallel with the surface of the floor panel.

Preferably, the bottom of the first undercut has an angle less than 10°, and more preferably less than 5°, with the surface of the floor panel. Even more preferably the bottom of the first protrusion is parallel with the surface of the floor panel.

Preferably, the bottom of the first undercut is substantially parallel with the bottom of the first protrusion.

Preferably, in coupled condition of two such panels at the second pair of opposite edges a space is present in horizontal direction between the distal end of the first protrusion and the proximal end of the first undercut; and/or a space is present between the top end of the first protrusion and the top end of the first undercut. If both spaces are present, preferably they form one continuous space.

Preferably, the first protrusion is provided at its panel edge below a first vertical closing plane of its edge. The first vertical closing plane is provided for making contact in coupled condition of two such floor panels with a second vertical closing plane of the corresponding edge of the coupled panel. The first undercut is provided below the second vertical closing plane. More preferably, in coupled condition of two such floor panels at the second pair of corresponding edges, a closing plane is provided by the first vertical closing plane contacting the second vertical closing plane. The downwards extension of the closing plane runs through the contact zone between the second and fourth locking part. More preferably, the intersection between the downwards extension of the closing plane and the second vertical contact zone occurs within the middle quarter of the second vertical contact zone.

Preferably, a second undercut is provided at the proximal end of the female part, above the first protrusion. Such embodiments have the particular benefit that milling of the coupling parts out of the substrate of the floor panel is facilitated.

Preferably, the second undercut is provided between the first protrusion and the first vertical closing plane. More preferably, the second undercut is smaller than the first undercut.

Preferably, in coupled condition of two such floor panels at the second pair of opposite edges a first space is present between the coupled opposite edges below the contact between the bottom of the first protrusion and the bottom of the first undercut on the one hand and on the other hand distal to the distal end of the downward-directed locking element.

Preferably, the first space continues into a second space between the bottom part of the downward-directed locking element and the upper part of the lip of the lower hook-shaped part.

Preferably, a section of the distal end of the downward-directed locking element below the first undercut extends in distal direction beyond the second closing plane.

Preferably, the first locking part is provided by a second protrusion at the proximal end of the downward-directed upper hook-shaped part. The third locking part is provided by a third undercut at the distal end of the upward-directed locking element.

Preferably, the bottom of the upward-directed locking element comprises a fourth undercut, more preferably over substantially the full length of the upward-directed locking element. Preferably, the height of the fourth undercut increases—more preferably continuously—in the distal direction of the upward directed lower hook-shaped part.

Preferably, from the bottom of the floor panel, the third undercut extends deeper into the panel than the fourth undercut.

Preferably, the third undercut is divided from the fourth undercut by a plane making an angle between 70° and 100° with the horizontal direction of the floor panel, more preferably this plane is substantially vertical.

Preferably, the second protrusion extends to the bottom of the floor panel.

A preferred floor panel comprises a first vertical closing plane provided at the edge of the second pair of opposite edges comprising the upward-directed lower hook-shaped part. The first vertical closing plane is provided for making contact in coupled condition of two such floor panels with a second vertical closing plane of the corresponding edge of the coupled panel. The ratio of the horizontal distance between the first vertical closing plane and the distal end of the lip comprising the upward-directed locking element, over the thickness of the floor panel is less than 1.1, preferably less than 1, more preferably less than 0.85. It is a benefit of such embodiments that floor panels are provided wherein a minimized amount of waste is created when milling the coupling parts of the second pair of opposite edges, while the floor panels can be coupled more easily and can be uncoupled by a turning movement.

Preferably, a further undercut is provided at the proximal end of the upper hook-shaped part below the second undercut.

Preferably, the upper surface of the second protrusion has an angle between 10 and 20°—for instance 15°—with the surface of the floor panel.

Preferably, the angle with the surface of the floor panel of the upper surface of the third undercut is between 5 and 15°, e.g. 10°.

Preferably, the angle with the surface of the floor panel of the upper surface of the third undercut is smaller than the angle with the surface of the floor panel of the upper surface of the second protrusion. More preferably the difference between these angles is at least 5°.

Preferably, the floor panel is configured such that in coupled condition of two such panels at the second pair of opposite edges no contact is present between the second protrusion and the third undercut.

In an alternative preferred embodiment, the floor panel is configured such that in coupled condition of two such panels at the second pair of opposite edges the second protrusion contacts the third undercut.

Preferably, the second protrusion extends till the level of the bottom surface of the floor panel.

Preferably, in coupled condition of two such panels at the second pair of opposite edges, a space is provided along the full upper side of the upward-directed locking element and along the lip of the upper hook-shaped part.

Preferably, the second undercut comprises an included angle larger than 90° between its top surface and its side surface.

Preferably, the bottom of the downward-directed locking element comprises a concave section.

Preferably, the bottom of the downward-directed locking element comprises a distal convex section and a proximal convex section. The concave section is provided between the distal convex section and the proximal distant section. The bottom of the downward-directed locking element is configured according to one or a combination of the following characteristics:

- the distal convex section is configured closer to the surface of the floor panel than the proximal convex section;
- the distal convex section and/or the proximal convex section comprises a section that is parallel with the surface of the floor panel;
- an inclined plane is provided between the distal convex section and the proximal convex section;
- in coupled condition of two such panels at the second pair of opposite edges the proximal convex section or the distal convex section—but not both—contacts the upper surface of the of the lip of the lower hook-shaped part;
- in coupled condition of two such panels at the second pair of opposite edges the proximal convex section as well as the distal convex section contact the upper surface of the lip of the lower hook-shaped part;
- in coupled condition of two such panels at the second pair of opposite edges a space is provided at the concave section between the downward-directed locking element and the upper surface of the lip of the lower hook-shaped part.

Preferably, the second vertical locking zone is provided closer to the surface of the floor panel than the first vertical locking zone. Such embodiments facilitate the uncoupling of coupled floor panels by means of a turning movement.

Preferably, the second vertical locking zone is provided in the bottom half of the thickness of the floor panel.

Preferably, at the lower edges of the downward-directed locking element, guiding surfaces, such as inclined parts or rounded parts, are present. These guiding surfaces are configured such that the male part during the downward movement thereof automatically is guided into the female part.

Preferably, the locking part of the second pair of edges has a locking surface, which, in downward direction, by means of a bend, merges into a lower-situated distal surface. This distal surface in downward direction also extends further in distal direction, more particularly is made sloping in downward direction.

Preferably, the lip of the lower hook-shaped part at the second pair of edges, seen in a cross-section transverse to the respective edge, is characterized by a first longitudinal portion, being the portion extending from the proximal end of the lower hook-shaped part up to the location where the upward-directed locking element is starting, and by a second longitudinal portion, which is defined as being the most distal 75% of the first longitudinal portion, wherein the lip is reduced in thickness by at least 5%, and more preferably at least 10% and even more preferably at least 30% inside the aforementioned second longitudinal portion. A more preferred floor panel comprises the following characteristics:

- the thickness reduction is realized at least by means of providing a deeper-situated portion in the upper side of the lip of the lower hook-shaped part;
- the thickness reduction is realized at least by means of providing a recess at the lower side of the lip of the lower hook-shaped part;
- the thickness reduction is realized at least by means of both measures mentioned in the above paragraphs, wherein preferably in cross-section and in a direction perpendicular to the respective edge there is an overlap between the aforementioned deeper-situated portion and said recess.

In a preferred embodiment, the upper surface of the lip of the upward-directed lower hook-shaped part comprises a proximal plane which is substantially parallel with the surface of the floor panel; and a distal plane which is substantially parallel with the surface of the floor panel. An inclined plane—flat or curved—is provided between—and preferably separates—the proximal plane and the distal plane. More preferably, the proximal plane is provided closer to the surface of the floor panel than the distal plane.

Preferably, in coupled condition of two such panels at the second pair of opposite edges, the distal plane is in contact with the downward-directed locking element. This contact can be made with or without pretension.

Preferably, in coupled condition of two such panels at the second pair of opposite edges, a space is provided at the inclined plane between the lip of the upward directed lower hook-shaped part and the downward-directed locking element.

Preferably, the upward-directed locking element is elastically bendable, preferably assisted by the presence of a fourth undercut on the lower side of the lip of the upward-directed lower hook-shaped part. More preferably the fourth undercut extends substantially along the full length of the upward-directed locking element, but not further.

Preferably, a fourth undercut is present on the lower side of the lip of the lower hook-shaped part. The height of the fourth undercut increases—preferably continuously—in the distal direction of the lower hook-shaped part.

Preferably, the male part is not split.

Preferably, the bottom of the panel at the edge where the upward-directed lower hook-shaped part is provided comprises a third protrusion directed substantially downwards. The second protrusion is provided extending from the third protrusion. The third protrusion directing substantially downwards can e.g. be provided by removal (e.g. by means of milling) of material at the bottom of the panel or can be otherwise provided, e.g. by extrusion. The third protrusion provides flexibility to the position of the second protrusion when coupling panels or when uncoupling coupled panels, as the third protrusion can be elastically bent.

In preferred embodiments, the coupling parts of the first pair of opposite edges are configured such that two of such panels can be coupled to each other at these edges by means of a turning movement (R). The coupling parts at the first pair of opposite edges more preferably comprise a tongue and a groove; and locking parts. It is noted that the vertically active locking system and horizontally active locking system of the first pair of edges can be realized in any manner. Preferably, however, for the vertically active locking system use can be made of a tongue and a groove, which groove is preferably bordered by a lower lip and an upper lip. For the horizontally active locking system, use is preferably made of locking parts, which are provided at the tongue and the groove and which, in coupled condition, hook behind each other. It is preferred that the lower lip distally extends to beyond the upper lip and that the locking part also shows a locking surface, which is situated beyond the distal end of the upper lip.

In preferred floor panels, a plurality of such floor panels can be coupled to each other at their respective edges by means of the fold-down principle to form a floor covering.

In preferred floor panels, the coupling parts of the first pair of opposite edges are configured such that two of such panels can be coupled to each other at these edges by means of a downward movement. More preferably, the coupling parts of the first pair of opposite edges are configured as described for the coupling parts of the second pair of opposite edges in any embodiment of the invention.

Preferred floor panels are oblong; wherein the first pair of opposite edges forms the long sides of the floor panel; and the second pair of opposite edges forms the short sides of the floor panel.

Preferably, wherein the upward-directed locking element and the downward-directed locking element are configured such that in coupled condition the proximal end of the downward-directed locking element contacts the proximal end of the upward-directed locking element. Thereby, the upward-directed locking element adopts a somewhat tilted position in respect to its position in uncoupled condition.

In a preferred floor panel, the edge of the second pair of opposite edges comprising the upward-directed lower hook-shaped part comprises a first vertical closing plane. The edge of the second pair of opposite edges comprising the downward-directed upper hook-shaped part comprises a second vertical closing plane. The first vertical closing plane of the floor panel is provided for contacting the second vertical closing plane of another such floor panel with which the floor panel is coupled at its second pair of opposite edges. The contact in coupled condition of two such floor panels at their second pair of opposite edges of the first vertical closing plane with the second vertical closing plane defines a closing plane. The locking surface of the downward-directed locking element is provided over its full surface proximal to the downwards extension of the second vertical closing plane. With "proximal to the downwards extension of the second vertical closing plane" is meant that the locking surface of the downward-directed locking element does not extend from proximal to the downwards extension of the second vertical closing plane beyond the downwards extension of the second vertical closing plane. The locking surface of the downward-directed locking element can extend up to the downwards extension of the second vertical closing plane.

It is a benefit of such embodiments that installation of the floor panels by means of the fold-down technique can be performed with a better locking. During the downwards movement of the downward-directed lower hook-shaped part, the edge will be less pushed away in the direction perpendicularly to the second pair of opposite edges. This pushing away also creates a back and forth shifting along its first pair of opposite edges of the floor panel being installed. This back and forth shifting can negatively affect the firmness of the locking of the floor panels at closing planes at the first pair of opposite edges of the panels. Such firmer locking is beneficial in order to prevent water penetration.

In a more preferred embodiment, the downward-directed locking element does not comprise parts extending in distal direction beyond the downwards extension of the second vertical closing plane.

In a preferred embodiment, in coupled condition of two such floor panels at their second pair of opposite edges, from the point of view of the edge comprising the downward-directed upper hook-shaped part the second vertical locking zone is located proximal to the downward extension of the closing plane.

In a preferred floor panel according to the invention, the coupling parts at the first edge of the first pair of opposite edges comprise a tongue and locking parts. The coupling parts at the second edge of the first pair of opposite edges comprise a groove and locking parts. The coupling parts of the first pair of opposite edges are configured such that two of such panels can be coupled to each other at these edges by means of a turning movement, wherein a locking is established in the direction perpendicular to the plane of the so-coupled panels as well as in the direction parallel with the plane of the so-coupled panels and perpendicular to the first pair of opposite edges. Over a certain length extending from the first edge of the first pair of opposite edges and measured along the edge comprising the upward-directed lower hook-shaped part, the upward-directed lower hook-shaped part consists of a lip devoid of the upward-directed locking element. Preferably the length over which the upward-directed lower hook-shaped part is devoid of the upward-directed locking element is at least 7 millimeter, more preferably at least 10 millimeter, more preferably at least 15 mm.

It is a benefit of such embodiment that installation of the floor panels by means of the fold-down technique is facilitated. A floor panel is coupled at the edge of the first pair of opposite edges comprising the tongue by means of a turning coupling. The panel is brought close to the edge of the second pair of opposite edges of an already installed panel; more specifically to the edge which comprises the female part. The panel is coupled to the already installed panel by means of a downward movement. The operation of the installation of the floor panel is facilitated as the panel can be brought closer to the edge of the already installed panel while being turned already lower, as the absence over a certain length of the upward-directed lower hook-shaped part means removal of a potential obstacle for the easy coupling of the panels.

In a preferred floor panel according to the invention, the edge of the second pair of opposite edges comprising the upward-directed lower hook-shaped part comprises a first vertical closing plane. The edge of the second pair of opposite edges comprising the downward-directed upper hook-shaped part comprises a second vertical closing plane. The second vertical closing plane of the floor panel is provided for contacting the first vertical closing plane of another such floor panel with which the floor panel is coupled at its second pair of opposite edges. In coupled condition, the contact of the first vertical closing plane of the floor panel with the second vertical closing plane of the another such floor panel defines a closing plane. When during the downward coupling movement of the floor panel relative to the another such floor panel the distal edge of the downward-directed locking element continuously contacts the proximal end of the opposing edge of the another such floor panel with which the floor panel is being coupled, at the moment the lowest point of the downward-directed locking element being moved downwards reaches the same height level as the highest point of the upward-directed locking element of the another such panel, the gap in horizontal direction and measured in the direction perpendicular to the second pair of opposite edges between the second vertical closing plane of the floor panel and the first vertical closing plane of the another such floor panel is less than 0.15 millimeter, preferably less than 0.1 millimeter, more preferably 0.08 millimeter It is a benefit of such embodiments that installation of the floor panels by means of the fold-down technique can be performed with a better locking. During the downwards movement of the downward-directed lower hook-shaped part, the panel edge is somewhat pushed away in the direction perpendicularly to the second pair of opposite edges. This pushing away—and later returning—can create a back and forth shifting along its first pair of opposite edges of the floor panel being installed. However, in floor panels according to this embodiment, this shifting is limited as the upward-directed locking element will limit this shifting as it is earlier in the downwards movement process of the downwards-directed upper hook-shaped part in contact with the downward-directed locking element.

In a preferred floor panel according to the invention, the lip of the upward-directed lower hook-shaped part comprises a slit parallel with the surface of the panel. More preferably, the slit extends in proximal direction to beyond the upward-directed locking element.

Preferably, the slit is towards the back of the panel delimited by a lower lip; and the lower lip extends distally less than the distal end of the upward-directed locking element.

In its different embodiments, the slit parallel with the surface of the panel is provided to enhance the ability of the upward-directed locking element to bend backwards when coupling two such panels. Such embodiments are of particular interest for panels comprising a substrate out of HDF (High Density Fiberboard); and even more for such panels that are thicker than 8 mm, or even being at least 10 mm thick.

A preferred floor panel further comprises one or more of the following characteristics, or any combination of these characteristics in mutual respect, and/or in combination with any of the characteristics of any embodiment of the invention, this as far as such combination does not have any contradictory characteristics:

- the coupling parts at the first and/or second pair of edges are made substantially as profiled parts in the material of the floor panel, more preferably substantially or entirely by means of a machining treatment, more preferably by means of one or more milling treatments, for example, with milling cutters which are active under different operative angles;

the coupling parts at the first and/or second pair of edges are made as millable profiled parts, which can be milled by means of milling cutters with a rotational axis which during milling is situated external to the floor panels;

the aforementioned male part is or is not split;

at the second pair of edges, only one male part is applied, whether or not split;

the center point of the second contact zone is situated higher than the center point of the first contact zone;

the coupling parts at the first pair and/or second pair of edges are configured such that in coupled condition a so-called pretension exists, which forces the respective floor panels at the respective edges towards each other, wherein this more preferably is performed by applying overlapping contours, and wherein the pretension is the result of a deformation, either an elastic bending or an elastic compression, or a combination of both;

the coupling parts at the second pair of edges are free from hook and loop fasteners and/or adhesive connections;

the floor panel is provided with chamfers or bevels on the first and/or second pair of edges; more preferably the chamfers or bevels are provided by impressions;

the floor panel has a top layer and/or decor layer which extends in one piece from the horizontal upper surface of the floor panel up to the chamfers;

the floor panel has a top layer with a decor.

A preferred floor panel comprises a substrate; or comprises or consists of one or a plurality of substrate layers. The substrate, or, in the case of a plurality of substrate layers, at least one of the substrate layers consists of a material fulfilling one or more, or any combination of the following characteristics, as far as such combination is not contradictory:

synthetic material-based material, foamed or not foamed, "resilient" or hard, whether or not comprising plasticizer, and whether or not filled with wood-based or bamboo-based material, for example, in the form of fibers, chips, dust or sawdust, and/or filled with other substances, for example, chalk, lime, talcum, ground fillers based on stone species;

synthetic material-based material, which is foamed with fine pores, such that the majority of the synthetic material-based material comprises pores and/or gas inclusions having dimensions smaller than 1 mm, and preferably smaller than 0.1 mm and more preferably smaller than 0.01 mm;

synthetic material-based material, which is obtained by extruding synthetic material-based starting material in the form of plate material, wherein, in a more preferred embodiment, this material is foamed, this in its turn more preferably with fine pores which are such that the majority of the synthetic material-based material comprises pores and/or gas inclusions having dimensions smaller than 1 mm, and better smaller than 0.1 mm and still better smaller than 0.01 mm;

synthetic material-based material, which is obtained by strewing synthetic material-based material, whether or not combined with other materials, by means of a strewing process and consolidating it under the influence of pressure and possibly increased temperature in the form of plate material, wherein in a preferred embodiment the obtained material is foamed, this in its turn more preferably with fine pores, which are such that the majority of the synthetic material-based material comprises pores and/or gas inclusions having dimensions smaller than 1 mm, and better smaller than 0.1 mm and still better smaller than 0.01 mm;

synthetic material consisting of, or on the basis of, or comprising one of the following materials: PP, PE, PET, PUR, PVC, PIR or other suitable synthetic materials;

synthetic material-based material with plasticizers, wherein the synthetic material-based material preferably is chosen from the materials listed in the preceding paragraph;

wood-based material, for example, MDF (medium density fiberboard), HDF (high density fiberboard), prefabricated wood panels, e.g. engineered wood panels, possibly with adapted core or end strips;

magnesia based material (e.g. MgO boards); preferably comprising fillers;

fibre cement based material;

gypsum based material, preferably gypsum board comprising fibers and/or filling particles;

the floor panel is made as one of the following kinds: as a laminate floor panel; as a so-called "resilient floor panel"; as a "LVT" panel or "CVT panel" (Continuous Vinyl Tile) or comparable thereto panel on the basis of another synthetic material than vinyl; as a floor panel with a first synthetic material-based, preferably foamed, substrate layer, with thereon a preferably thinner second substrate layer of or on the basis of vinyl or another synthetic material; as a floor panel with a hard synthetic material-based substrate.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF VARIOUS EMBODIMENTS

Figure 1:
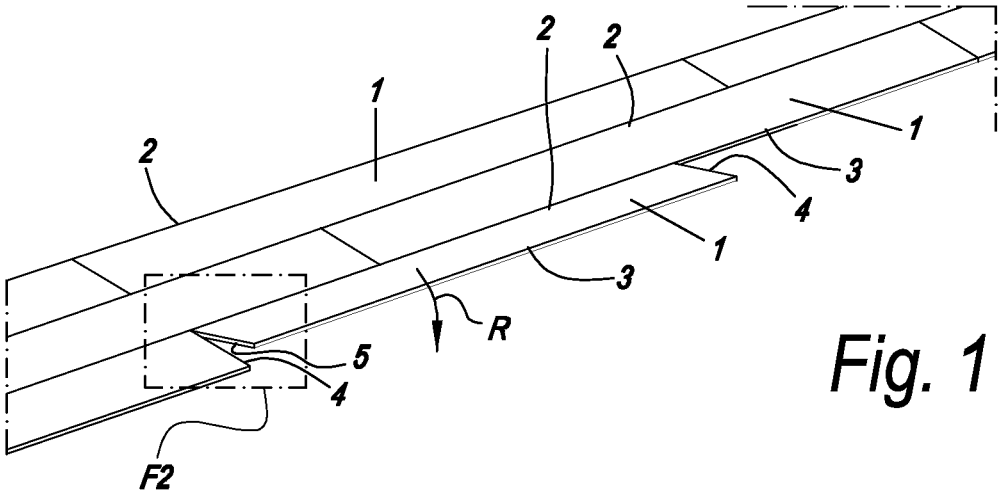
FIG. 1 schematically and in perspective represents a portion of a floor covering, which consists of floor panels according to an example of the invention.
Figure 2:
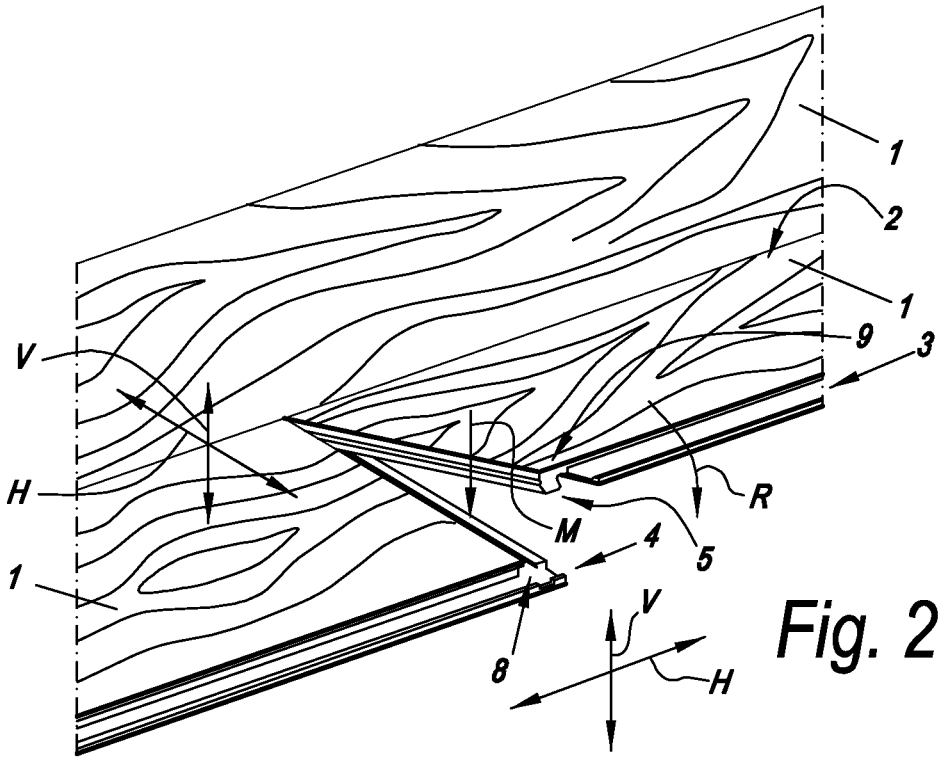
FIG. 2, at a larger scale, represents the portion indicated by F2 in FIG. 1.

As represented in FIGS. 1 and 2, the invention relates to floor panels (1) for forming a floor covering, which floor panels (1) comprise a first pair of opposite edges (2, 3), as well as a second pair of opposite edges (4, 5). The floor panels are rectangular and oblong.

The represented floor panels (1) are configured such at their edges that they can be mutually coupled according to the so-called fold-down principle, which is a principle known as such and which consists in that such floor panels (1) can be coupled to each other at the first pair of edges (2, 3) by means of a turning movement (R) and can be coupled to each other at the second pair of edges (4, 5) by means of a downward movement (M), wherein the downward movement (M) is the result of the turning movement (R) and thus substantially is realized simultaneously. Herein, the floor panels (1) are configured such that at their edges (2, 3) and (4, 5) a locking in vertical direction (V) as well as in horizontal direction (H) is obtained, this latter perpendicular to the respective edges.

As represented in FIGS. 3 to 6, such floor panel 1 can be provided with coupling parts (6, 7) at its first pair of edges (2, 3). At the second pair of edges (4, 5) coupling parts (8, 9) are also provided. The coupling parts will be described in greater detail in FIGS. 4 to 6.

Figure 5:
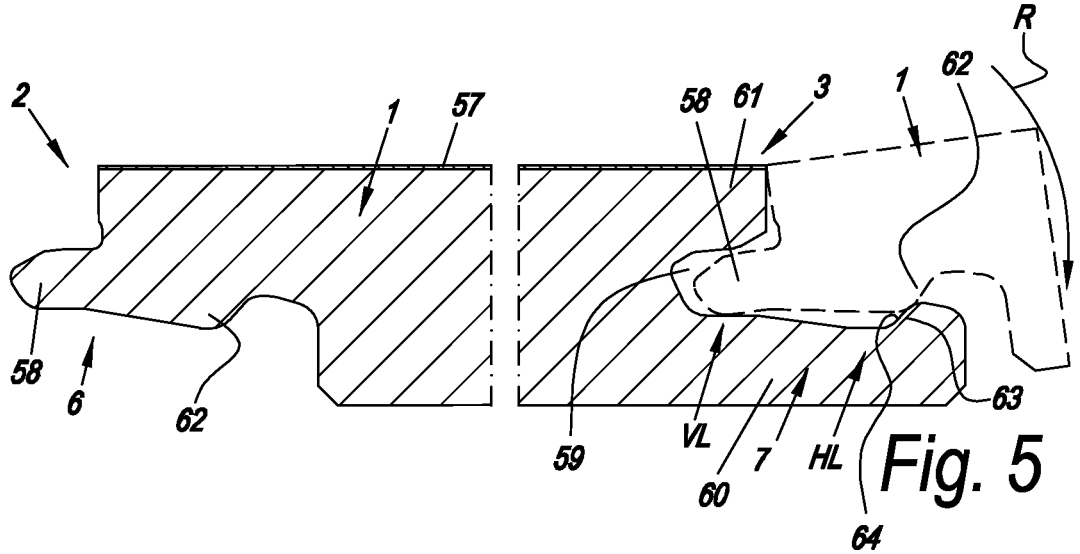

As can be seen in FIG. 5, the coupling parts (6, 7) of the first pair of edges (2, 3) can show at least the following characteristics:

- the coupling parts (6, 7) comprise a horizontally active locking system (HL), which, in a coupled condition of two of such floor panels (1), effects a locking in the plane of the floor panels (1) and perpendicular to the respective edges (2, 3);
- the coupling parts (6, 7) also comprise a vertically active locking system (VL), which, in a coupled condition of two of such floor panels (1), effects a locking transverse to the plane of the floor panels, in other words, in vertical direction;
- the coupling parts (6, 7) substantially are realized of the material of the floor panel (1) itself; and
- the coupling parts (6, 7) are configured such that two of such floor panels (1) can be coupled to each other at these edges by means of a turning movement (R).

The coupling parts (6, 7) at the first pair of opposite edges (2, 3) comprise a tongue (58) and a groove (59), and locking parts (62, 63). The vertically active locking system (VL) and the horizontally active locking system (HL) of the first pair of edges (2, 3) can be realized in any manner. Preferably, as shown in FIG. 5, for the vertically active locking system (VL) use can be made of a tongue (58) and a groove (59), which groove preferably is bordered by a lower lip (60) and an upper lip (61). For the horizontally active locking system, use can be made of locking parts (62, 63), which are provided at the tongue and the groove and which, in coupled condition, hook behind each other. It is preferred that the lower lip (60) distally extends to beyond the upper lip (61) and that the locking part (63) also shows a locking surface, which is situated beyond the distal end of the upper lip (61).

Figure 3:
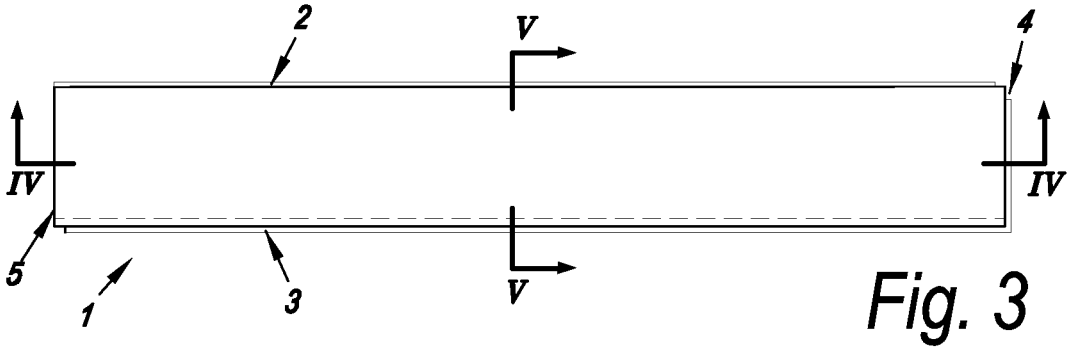
FIG. 3, in top view, represents a floor panel from the floor covering of FIGS. 1 and 2.
Figure 4:
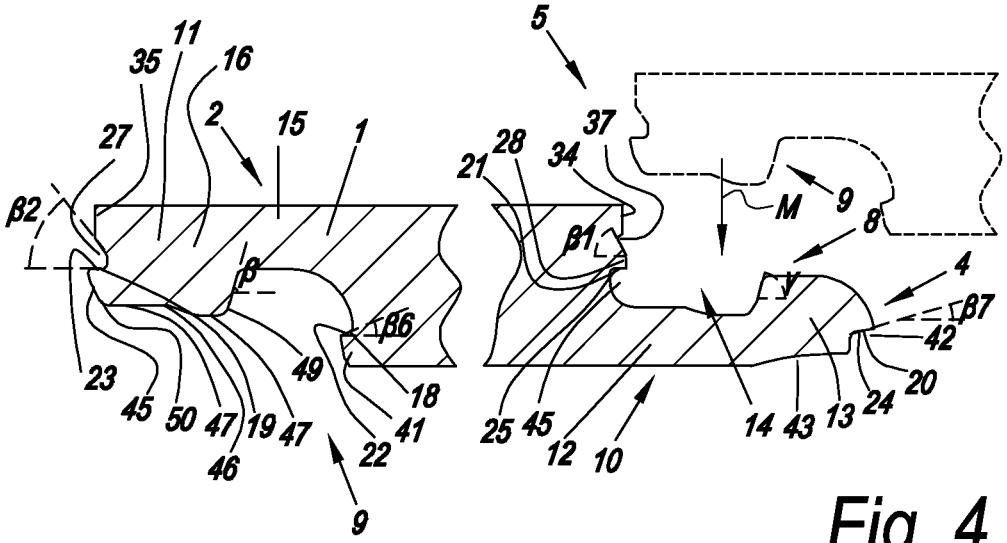
FIGS. 4 and 5, at a larger scale, represent cross-sections according to lines IV-IV and V-V, respectively, of FIG. 3.
Figure 6:
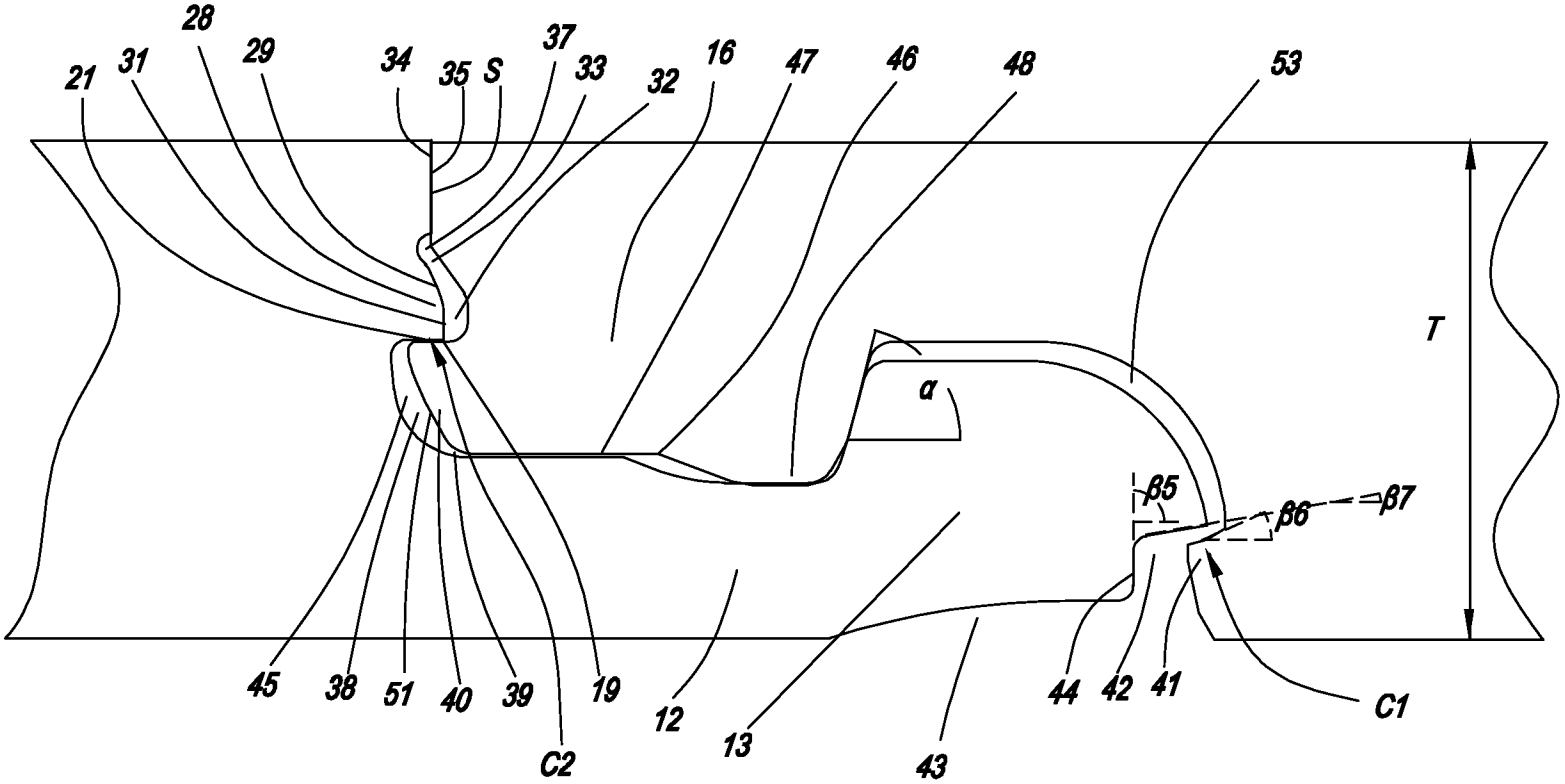
FIG. 6 represents the coupling parts, which are visible in FIG. 4, at a larger scale in coupled condition.

FIG. 4 represent the cross-section according to lines IV-IV of FIG. 3. FIG. 6 represents the coupling parts (8, 9) of the second pair of edges (4,5), which are visible in FIG. 4, at a larger scale, in coupled condition. The second pair of opposite edges (4-5) comprises coupling parts (8-9) on both edges, which allow that two of such floor panels (1) mutually can be coupled to each other. The coupling parts (8-9) comprise a horizontally active locking system, which, in a coupled condition of two of such floor panels (1), effects a locking in the plane of the floor panels (1) and perpendicular to the respective edges (4-5). The coupling parts (8-9) also comprise a vertically active locking system, which, in a coupled condition of two of such floor panels (1), effects a locking transverse to the plane of the floor panels. The coupling parts (8-9) substantially are realized from the material of the floor panel (1) itself. The horizontally active locking system of the second pair of edges (4, 5) is formed at least of an upward-directed lower hook-shaped part (10) which is situated on one of said two edges (4), as well as a downward-directed upper hook-shaped part (11), which is situated on the opposite edge (5). The upward-directed lower hook-shaped part (10) consists of a lip (12) with an upward-directed locking element (13), which proximally thereof defines a female part (14) in the form of a recess, whereas the downward-directed upper hook-shaped part (11) consists of a lip (15) with a downward-directed locking element (16) forming a male part (17). The male part (17) is not split. The coupling parts (8-9) of the second pair of opposing edges (4,5) are configured such that two of such floor panels (1) can be coupled to each other at their respective edges (4-5) by means of a downward movement (M)—in the example involving a downward snapping movement—of the one floor panel in respect to the other. The vertically active locking system of the second pair of opposing edges (4,5) comprises vertically active locking parts (18-19-20-21), which, by means of respective locking surfaces (22-23-24-25), define at least a first vertical locking zone (C1) and a second vertical locking zone (C2). In coupled condition of two such panels the first vertical locking zone (C1) is located at the distal end of the upward-directed locking element (13); and the second vertical locking zone (C2) is situated at the distal end of the downward-directed locking element (16). The vertically active locking parts comprise a first locking part (18) at the edge of the panel at the proximal end of the lip (15) of the upper hook-shaped part (11), a second locking part (19) at the distal end of the downward-directed locking element (16), as well as a third locking part (20) at the distal end of the lip (12) of the lower hook-shaped part (10) and a fourth locking part (21) at the proximal end of the female part (14). The first and the third locking part (18, 20), in the coupled condition of two of such floor panels (1), define the first vertical locking zone (C1). The second and fourth locking part (19, 21), in the coupled condition of two of such floor panels (1), define said second vertical locking zone (C2).

In coupled condition at the second pair of edges (4,5) of two such floor panels (1), no vertical locking is provided between the proximal end of the downward-directed locking element (16) and the proximal end of the upward-directed locking element (13). More particularly, the floor panels (1) are configured such that the first vertical locking zone (C1) and the second vertical locking zone (C2) are the only zones where a vertical locking is provided in coupled condition of two such floor panels between the edges of their second pair of opposite edges (4,5).

The first vertical locking zone (C1) is provided at least at ⅔ of the thickness (T) of the floor panel from the surface of the floor panel.

In the exemplary embodiment shown in FIGS. 4 and 6, the angle (β) between the proximal end of the downward-directed locking element (16) and the horizontal direction in the proximal direction of the upper hook-shaped part (11) is 75°. The angle (γ) between the proximal end of the upward-directed locking element (13) and the horizontal direction in the distal direction of the lower hook-shaped part (10) is 75°.

In coupled condition at the second pair of edges (4,5) of two such floor panels, the proximal end of the downward-directed locking element (16) contacts the proximal end of the upward-directed locking element (13). The angle (α) of the contact between the proximal end of the downward-directed locking element (16) and the proximal end of the upward-directed locking element (13); and the horizontal direction in the direction towards the distal end of the upward-directed locking element (13) is 75°. In the example shown, the proximal end of the downward-directed locking element (16) contacts the proximal end of the upward-directed locking element (13) with pretension. Alternatively, embodiments are possible wherein the proximal end of the downward-directed locking element (16) contacts the proximal end of the upward-directed locking element (13) without pretension.

In the floor panels shown in FIGS. 4 and 6, the second locking part (19) is provided by a first undercut (27) at the distal end of the downward-directed locking element (16) and the fourth locking part (21) is provided by a first protrusion (28) at the proximal end of the female part (14). In coupled condition of two such floor panels (1) at the second pair of opposite edges (4,5), the bottom of the first undercut (27) contacts the bottom of the first protrusion (28).

In the exemplary embodiment, the included angle (β1) of the first protrusion (28) is larger than the included angle (β2) of the first undercut (27), in the example, β2 equals 84° and the angle β1 equals 90°. The first undercut (27) has a triangular shape with rounded corner points.

The bottom of the first protrusion (28) in the example is parallel with the surface of the floor panel; the bottom of the first undercut (27) is parallel with the surface of the floor panel. The bottom of the first undercut (27) is substantially parallel with the bottom of the first protrusion (28).

In coupled condition of two such panels at the second pair of opposite edges (4,5) a space (32) is present in horizontal direction between the distal end of the first protrusion (28) and the proximal end of the first undercut (27); and a space (33) is present between the top end of the first protrusion (28) and the top end of the first undercut (27). Both spaces (32, 33) form one continuous space.

The first protrusion (28) is provided at its panel edge below a first vertical closing plane (34) of its edge. The first vertical closing plane (34) is provided for making contact in coupled condition of two such floor panels with a second vertical closing plane (35) of the corresponding edge of the coupled panel. The first undercut (27) is provided below the second vertical closing plane (35). In coupled condition of two such floor panels at the second pair of corresponding edges (4,5), a closing plane (S) is provided by the first vertical closing plane (34) contacting the second vertical closing plane (35). The downwards extension of the closing plane (S) runs through the contact zone between the second and fourth locking part (19, 21). The intersection between the downwards extension of the closing plane (S) and the second vertical contact zone (C2) occurs within the middle quarter of the second vertical contact zone (C2).

At the proximal end of the female part (14), a second undercut (37) is provided above the first protrusion (28). The second undercut (37) is provided between the first protrusion (28) and the first vertical closing plane (34). The second undercut (37) is smaller than the first undercut (27).

In coupled condition of two such floor panels at the second pair of opposite edges (4,5) a first space (38) is present between the coupled opposite edges (4,5) below the contact between the bottom of the first protrusion (28) and the bottom of the first undercut (27) on the one hand and on the other hand distal to the distal end of the downward-directed locking element (16). The first space (38) continues into a second space (39) between the bottom part of the downward-directed locking element (16) and the upper part of the lip (12) of the lower hook-shaped part (10).

A section (40) of the distal end of the downward-directed locking element below the first undercut (27) extends in distal direction beyond the second closing plane (35).

The first locking part (18) is provided by a second protrusion (41) at the proximal end of the downward directed upper hook-shaped part (11). The third locking part (20) is provided by a third undercut (42) at the distal end of the upward-directed locking element (13). The bottom of the upward-directed locking element (13) comprises a fourth undercut (43), extending over substantially the full length of the upward-directed locking element (13). The height of the fourth undercut (43) increases continuously in the distal direction of the upward directed lower hook-shaped part (10). From the bottom of the floor panel, the third undercut (42) extends deeper into the panel than the fourth undercut (43). The third undercut (42) is divided from the fourth undercut (43) by a plane (44) making an angle (β5) of 90° with the horizontal direction of the floor panel.

The second protrusion (41) extends to the bottom of the floor panel.

A further undercut (45) is provided at the proximal end of the upper hook-shaped part (11) below the second undercut (37).

The upper surface of the second protrusion (41) has an angle (β6) 15° with the surface of the floor panel. The angle (β7) with the surface of the floor panel of the upper surface of the third undercut (42) is 10°. Thus, in this exemplary embodiment, the angle (β7) with the surface of the floor panel of the upper surface of the third undercut (42) is smaller than the angle (β6) with the surface of the floor panel of the upper surface of the second protrusion (41); the difference in the example being 5°.

The floor panel is configured such that in coupled condition of two such panels at the second pair of opposite edges (4,5) no contact is present between the second protrusion (41) and the third undercut (42).

The second protrusion (41) extends till the level of the bottom surface of the floor panel In coupled condition of two such panels at the second pair of opposite edges (4,5) a space (53) is provided along the full upper side of the upward-directed locking element (13) and along the lip (15) of the upper hook-shaped part (11).

The second undercut (37) comprises an included angle larger than 90° between its top surface and its side surface.

The bottom of the downward-directed locking element (16) comprises a concave section (46). The bottom of the downward-directed locking element (16) comprises a distal convex section (47) and a proximal convex section (48). The concave section (46) is provided between the distal convex section and the proximal distant section. The bottom of the downward-directed locking element (16) is configured according to the following characteristics:

- the distal convex section (47) is configured closer to the surface of the floor panel than the proximal convex section (48);
- the distal convex section (47) and the proximal convex section (48) both comprise a section that is parallel with the surface of the floor panel;
- an inclined plane is provided between the distal convex section and the proximal convex section;
- in coupled condition of two such panels at the second pair of opposite edges (4,5) the proximal convex section (48)—but not the distal convex section (47)—contacts the upper surface of the of the lip (12) of the lower hook-shaped part (10);

in coupled condition of two such panels at the second pair of opposite edges (4,5) the proximal convex section as well as the distal convex section contact the upper surface of the lip (12) of the lower hook-shaped part (10);

in coupled condition of two such panels at the second pair of opposite edges (4,5) a space is provided at the concave section between the downward-directed locking element (16) and the upper surface of the lip (12) of the lower hook-shaped part (10).

The second vertical locking zone (C2) is provided closer to the surface of the floor panel than the first vertical locking zone (C1). The second vertical locking zone (C2) is provided in the bottom half of the thickness (T) of the floor panel.

At the lower edges of the downward-directed locking element (16), guiding surfaces (49, 50), in the example inclined and rounded parts, are present, which are configured such that the male part during the downward movement thereof is guided automatically into the female part.

The locking part (19) of the second pair of edges (4-5) has a locking surface (23), which, in downward direction, by means of a bend, merges into a lower-situated distal surface (51), wherein this distal surface (51) in downward direction also extends further in distal direction, more particularly is made sloping in downward direction.

The upper surface of the lip (12) of the lower hook-shaped part (10) comprises a proximal plane which is substantially parallel with the surface of the floor panel and a distal plane which is substantially parallel with the surface of the floor panel, wherein a flat inclined plane is provided between and separating the proximal plane and the distal plane. The proximal plane is provided closer to the surface of the floor panel than the distal plane. In coupled condition of two such panels at the second pair of opposite edges, the distal plane is in contact with the downward-directed locking element (16), wherein the contact is made with pretension. It is meant the downward-directed locking element (16) pushes during coupling onto the lip (12), resulting in an elastic bending of the lip (12).

In coupled condition of two such panels at the second pair of opposite edges (4,5) a space is provided at the inclined plane between the lip (12) of the lower hook-shaped part (10) and the downward-directed locking element (16).

The upward-directed locking element (13) is elastically bendable, in the exemplary embodiment assisted by the presence of the fourth undercut (43) on the lower side of the lip of the lower hook-shaped part (10). The fourth undercut (43) extends substantially along the full length of the upward-directed locking element (13), but not further. The fourth undercut (43) is present on the lower side of the lip of the lower hook-shaped part (10). The height of the fourth undercut (43) increases continuously in the distal direction of the lower hook-shaped part (10).

In embodiments of the invention, the upward-directed locking element (13) and the downward-directed locking element (16) can be configured such that in coupled condition the proximal end of the downward-directed locking element(16) contacts the proximal end of the upward-directed locking element (13) wherein the upward-directed locking element (13) adopts a somewhat tilted position in respect to its position in uncoupled condition.

Figure 7:
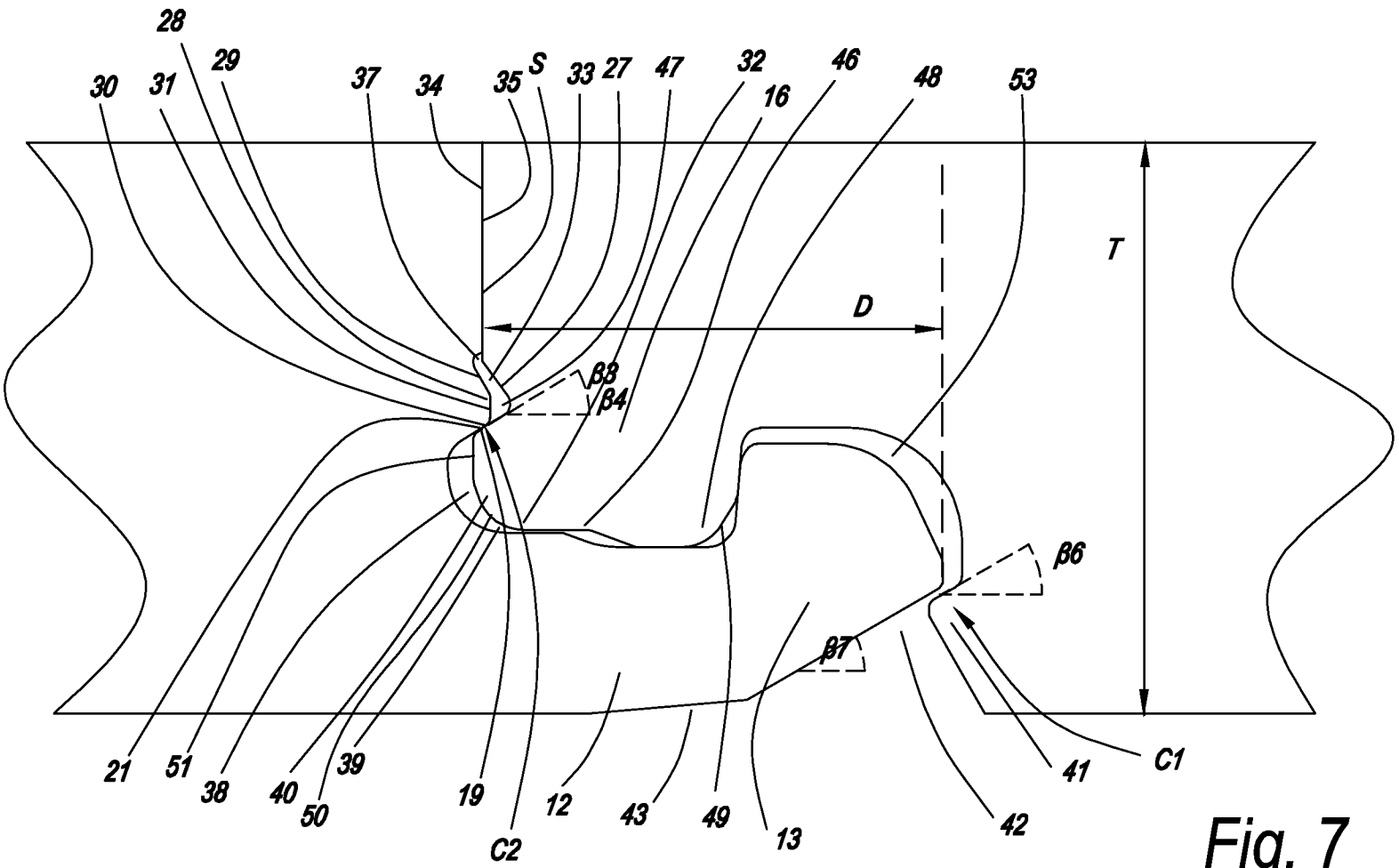
FIG. 7 shows—in coupled condition—an alternative embodiment according to the invention for the coupling parts shown in FIG. 6.

FIG. 7 shows—in coupled condition—an alternative embodiment according to the invention for the coupling parts of the second pair of opposite edges (4, 5) shown in FIG. 6. The coupling parts of the example of FIG. 7 are to a large extent similar to the coupling parts of FIG. 6, however, there are a few differences. The second pair of opposite edges (4, 5)—as shown in FIG. 7—comprises coupling parts (8, 9) on both edges, which allow that two of such floor panels (1) mutually can be coupled to each other. These coupling parts comprise a horizontally active locking system, which, in a coupled condition of two of such floor panels (1), effects a locking in the plane of the floor panels (1) and perpendicular to the respective edges (4-5). The coupling parts (8, 9) also comprise a vertically active locking system, which, in a coupled condition of two of such floor panels (1), effects a locking transverse to the plane of the floor panels. The coupling parts (8-9) substantially are realized from the material of the floor panel (1) itself. The horizontally active locking system of the second pair of edges (4, 5) is formed of an upward-directed lower hook-shaped part (10) which is situated on one of said two edges (4), as well as a downward-directed upper hook-shaped part (11), which is situated on the opposite edge (5). The upward-directed lower hook-shaped part (10) consists of a lip (12) with an upward-directed locking element (13), which proximally thereof defines a female part (14) in the form of a recess. The downward-directed upper hook-shaped part (11) consists of a lip (15) with a downward-directed locking element (16) forming a male part (17). The male part is not split.

The coupling parts (8-9) of the second pair of opposing edges (4,5) are configured such that two of such floor panels (1) can be coupled to each other at their respective edges (4-5) by means of a downward movement (M) involving a downward snapping movement of the one floor panel in respect to the other. The vertically active locking system of the second pair of opposing edges (4, 5) comprises vertically active locking parts (18, 19, 20, 21), which, by means of respective locking surfaces (22, 23, 24, 25), define at least a first vertical locking zone (C1) and a second vertical locking zone (C2). In coupled condition of two such panels, the first vertical locking zone (C1) is located at the distal end of the upward-directed locking element (13); and the second vertical locking zone (C2) is situated at the distal end of the downward-directed locking element (16).

The vertically active locking parts comprise a first locking part (18) at the edge of the panel at the proximal end of the lip (15) of the upper hook-shaped part (11), a second locking part (19) at the distal end of the downward-directed locking element (16), as well as a third locking part (20) at the distal end of the lip (12) of the lower hook-shaped part (10) and a fourth locking part (21) at the proximal end of the female part (14). The first and third locking part (18, 20), in the coupled condition of two of such floor panels (1), define the first vertical locking zone (C1). The second and fourth locking part (19, 21), in the coupled condition of two of such floor panels (1), define the second vertical locking zone (C2).

In coupled condition at the second pair of edges (4,5) of two such floor panels (1), no vertical locking is provided between the proximal end of the downward-directed locking element (16) and the proximal end of the upward-directed locking element (13).

The floor panel is configured such that the first vertical locking zone (C1) and the second vertical locking zone (C2) are the only zones where a vertical locking is provided in coupled condition of two such floor panels between the edges of their second pair of opposite edges (4,5).

The first vertical locking zone (C1) is provided at least at ⅔ of the thickness (T) of the floor panel from the surface of the floor panel.

The angle (β) between the proximal end of the downward-directed locking element (16) and the horizontal direction in the proximal direction of the upper hook-shaped part (11) is 86° in the example shown in FIG. 7.

The angle (γ) between the proximal end of the upward-directed locking element (13) and the horizontal direction in the distal direction of the lower hook-shaped part (10) 86° in the example of FIG. 7.

In coupled condition at the second pair of edges (4, 5) of two such floor panels, the proximal end of the downward-directed locking element (16) contacts the proximal end of the upward-directed locking element (13). The angle (α) of the contact between the proximal end of the downward-directed locking element (16) and the proximal end of the upward-directed locking element (13); and the horizontal direction in the direction towards the distal end of the upward-directed locking element (13) is 86°.

The second locking part (19) is provided by a first undercut (27) at the distal end of the downward-directed locking element (16). The fourth locking part (21) is provided by a first protrusion (28) at the proximal end of the female part (14). In coupled condition of two such floor panels (1) at the second pair of opposite edges (4, 5), the bottom of the first undercut (27) contacts the bottom of the first protrusion (28).

The included angle (β1, 90°) of the first protrusion (28) is larger than the included angle (β2, 84°) of the first undercut (27). The first undercut (27) has a triangular shape with rounded corner points. The first protrusion (28) comprises two inclined outer surfaces (29, 30) with in between the two inclined outer surfaces a vertical surface (31). The upper inclined surface (29) is more inclined with respect to the surface of the floor panel than the lower inclined surface (30). The bottom of the first protrusion (28) has an angle (β3) of 30° with the surface of the floor panel. The bottom of the first undercut (27) also has an angle (β4) of 30° with the surface of the floor panel. Thus, in the example shown in FIG. 7, the bottom of the first undercut (27) is substantially parallel with the bottom of the first protrusion (28).

In coupled condition of two such panels at the second pair of opposite edges (4,5) a space (32) is present in horizontal direction between the distal end of the first protrusion (28) and the proximal end of the first undercut (27). A space (33) is present between the top end of the first protrusion (28) and the top end of the first undercut (27) Both spaces (32, 33) form one continuous space.

The first protrusion (28) is provided at its panel edge below a first vertical closing plane (34) of its edge. The first vertical closing plane (34) is provided for making contact in coupled condition of two such floor panels with a second vertical closing plane (35) of the corresponding edge of the coupled panel. The first undercut (27) is provided below the second vertical closing plane (35). In coupled condition of two such floor panels at the second pair of corresponding edges (4,5), a closing plane (S) is provided by the first vertical closing plane (34) contacting the second vertical closing plane (35). The downwards extension of the closing plane (S) runs through the contact zone between the second and fourth locking part (19, 21). The intersection between the downwards extension of the closing plane (S) and the second vertical contact zone (C2) occurs within the middle quarter of the second vertical contact zone (C2).

The ratio (D/T) of the horizontal distance D between the first vertical closing plane (34) and the distal end of the lip (12) comprising the upward-directed locking element (13), over the thickness (T) of the floor panel is 0.81 in the exemplary floor panels shown in FIG. 7.

At the proximal end of the female part (14), a second undercut (37) is provided above the first protrusion (28). The second undercut (37) is provided between the first protrusion (28) and the first vertical closing plane (34). The second undercut (37) is smaller than the first undercut (27).

A first space (38) is present between the coupled opposite edges (4,5) below the contact between the bottom of the first protrusion (28) and the bottom of the first undercut (27) on the one hand and on the other hand distal to the distal end of the downward-directed locking element (16). This first space (38) continues into a second space (39) between the bottom part of the downward-directed locking element (16) and the upper part of the lip (12) of the lower hook-shaped part (10).

A section (40) of the distal end of the downward-directed locking element below the first undercut (27) extends in distal direction beyond the second closing plane (35).

The first locking part (18) is provided by a second protrusion (41) at the proximal end of the downward directed upper hook-shaped part (11). The third locking part (20) is provided by a third undercut (42) at the distal end of the upward-directed locking element (13).

The bottom of the upward-directed locking element (13) comprises a fourth undercut (43), extending over substantially the full length of the upward-directed locking element (13). The height of the fourth undercut (43) increases continuously in the distal direction of the upward directed lower hook-shaped part (10). From the bottom of the floor panel, the third undercut (42) extends deeper into the panel than the fourth undercut (43).

The second protrusion (41) extends to the bottom of the floor panel.

A further undercut (45) is provided at the proximal end of the upper hook-shaped part (11) below the second undercut (37).

The upper surface of the second protrusion (41) has an angle (β6) of 30° with the surface of the floor panel. The angle (β7) with the surface of the floor panel of the upper surface of the third undercut (42) is 30°.

The floor panel is configured such that in coupled condition of two such panels at the second pair of opposite edges (4,5) no contact is present between the second protrusion (41) and the third undercut (42).

The second protrusion (41) extends till the level of the bottom surface of the floor panel.

In coupled condition of two such panels at the second pair of opposite edges (4, 5) a space (53) is provided along the full upper side of the upward-directed locking element (13) and along the lip (15) of the upper hook-shaped part (11).

The bottom of the downward-directed locking element (16) comprises a concave section (46). The bottom of the downward-directed locking element (16) comprises a distal convex section (47) and a proximal convex section (48). The concave section (46) is provided between the distal convex section and the proximal distant section. The bottom of the downward-directed locking element (16) is configured according to the following characteristics:

- the distal convex section is configured closer to the surface of the floor panel than the proximal convex section;
- the distal convex section and the proximal convex section each comprise a section that is parallel with the surface of the floor panel;
- an inclined plane is provided between the distal convex section and the proximal convex section;
- in coupled condition of two such panels at the second pair of opposite edges (4, 5) the proximal convex section— but not the distal convex section—contacts the upper surface of the of the lip (12) of the lower hook-shaped part (10);

in coupled condition of two such panels at the second pair of opposite edges (4, 5) a space is provided at the concave section between the downward-directed locking element (16) and the upper surface of the lip (12) of the lower hook-shaped part (10).

The second vertical locking zone (C2) is provided closer to the surface of the floor panel than the first vertical locking zone (C1). The second vertical locking zone (C2) is provided in the bottom half of the thickness (T) of the floor panel.

At the lower edges of the downward-directed locking element (16), guiding surfaces (49, 50), more particularly inclined parts with rounded parts, are present, which are configured such that the male part during the downward movement thereof automatically is guided into the female part.

The locking part (19) of the second pair of edges (4, 5) has a locking surface (23), which, in downward direction, by means of a bend, merges into a lower-situated distal surface (51), wherein this distal surface (51) in downward direction also extends further in distal direction, more particularly is made sloping in downward direction.

The upper surface of the lip (12) of the lower hook-shaped part (10) comprises a proximal plane which is substantially parallel with the surface of the floor panel and a distal plane which is substantially parallel with the surface of the floor panel. An inclined plane—flat in the example of FIG. 7—is provided between and separates the proximal plane and the distal plane. The proximal plane is provided closer to the surface of the floor panel than the distal plane.

In coupled condition of two such panels at the second pair of opposite edges, the distal plane is in contact with the downward-directed locking element (16), the contact is made with pretension.

In coupled condition of two such panels at the second pair of opposite edges (4, 5) a space is provided at the inclined plane between the lip (12) of the lower hook-shaped part (10) and the downward-directed locking element (16).

The upward-directed locking element (13) is elastically bendable, assisted by the presence of a fourth undercut (43) on the lower side of the lip of the lower hook-shaped part (10). The fourth undercut (43) extends substantially along the full length of the upward-directed locking element (13), but not further. A fourth undercut (43) is present on the lower side of the lip of the lower hook-shaped part (10). The height of the fourth undercut (43) increases continuously in the distal direction of the lower hook-shaped part (10).

Figure 8:
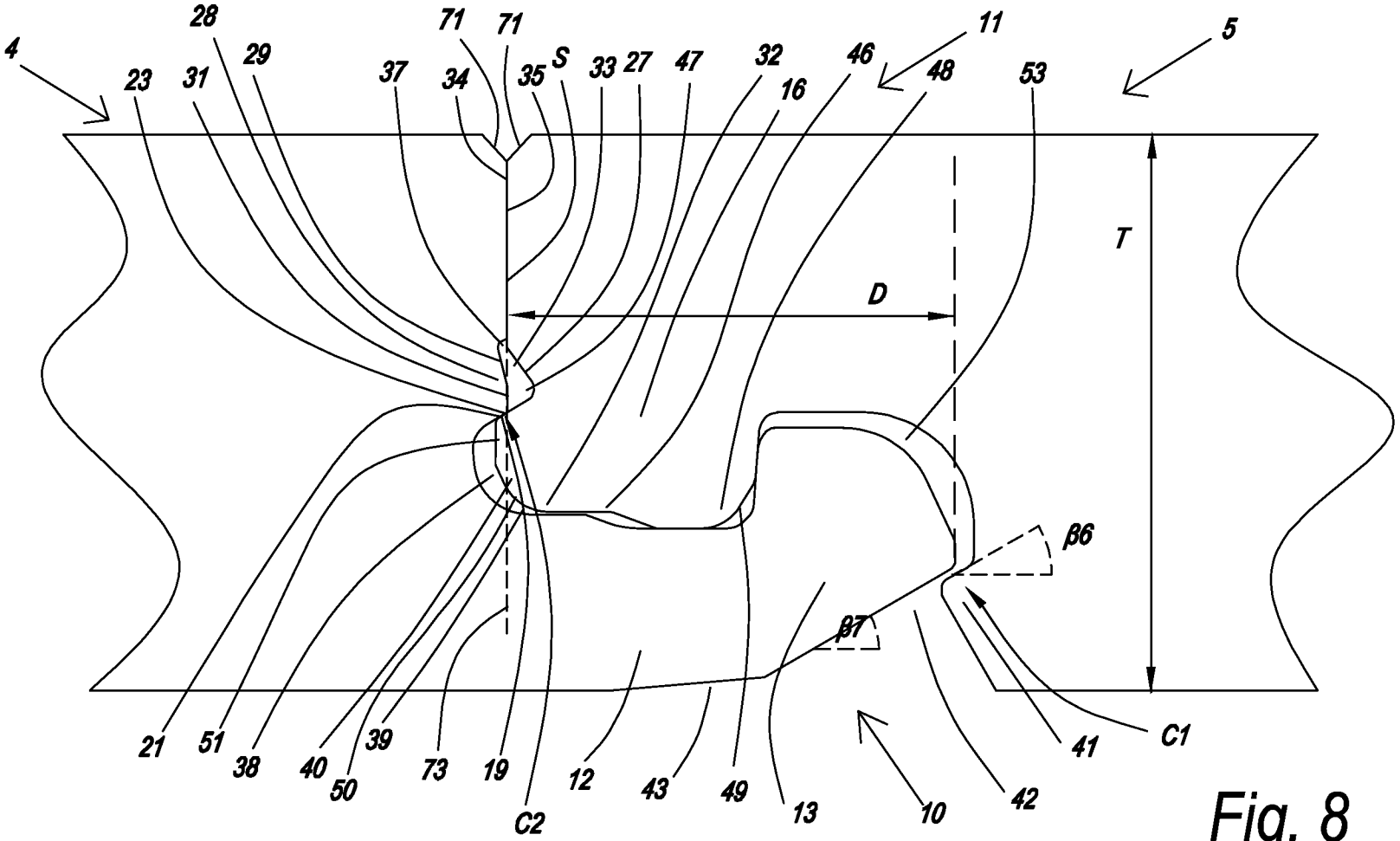
FIG. 8 illustrates—in a view similar to FIG. 6—an embodiment of the invention.

FIG. 8 illustrates—in a view similar as in FIG. 6—an embodiment of the invention. The reference numerals of FIG. 8 not explained in this paragraph have the same meaning as in FIG. 6. FIG. 8 illustrates two panels according to the invention coupled at their second pair of opposite edges (4, 5). The edge (4) of the second pair of opposite edges (4, 5) comprising the upward-directed lower hook-shaped part (10) comprises a first vertical closing plane (34). The edge (5) of the second pair of opposite edges (4, 5) comprising the downward-directed upper hook-shaped part (11) comprises a second vertical closing plane (35). The first vertical closing plane (34) of the floor panel is provided for contacting the second vertical closing plane (35) of another such floor panel with which the floor panel is coupled at its second pair of opposite edges. The contact in coupled condition of two such floor panels at their second pair of opposite edges of the first vertical closing plane (34) with the second vertical closing plane (35) defines a closing plane (S). The locking surface (23) of the downward-directed locking element (16) is provided over its full surface proximal to the downwards extension (73) of the second vertical closing plane (35). The locking surface of the downward-directed locking element does not extend from proximal to the downwards extension of the second vertical closing plane beyond the downwards extension of the second vertical closing plane. In the example shown, the locking surface of the downward-directed locking element extends up to the downwards extension of the second vertical closing plane. The downward-directed locking element (16) does not comprise parts extending in distal direction beyond the downwards extension (73) of the second vertical closing plane (35). In coupled condition of two such floor panels at their second pair of opposite edges (4, 5), from the point of view of the edge (5) comprising the downward-directed upper hook-shaped part (11) the second vertical locking zone (C2) is located proximal to the downward extension (73) of the closing plane (S). The panel edges shown in FIG. 8 are provided with bevels (71).

Figure 9:
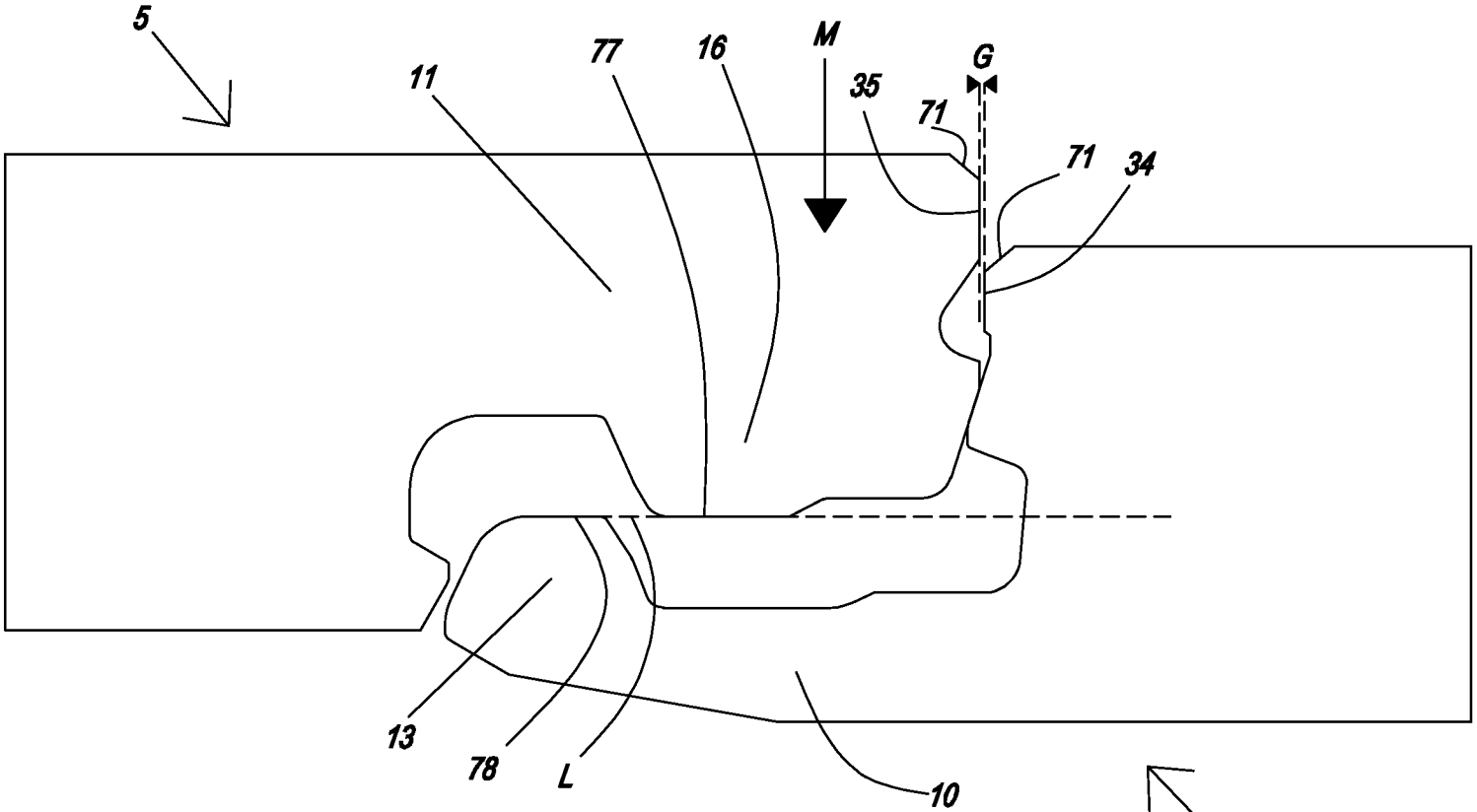
FIG. 9 shows—in a view illustrating the downward movement of two panels for coupling these panels at their second pair of opposite edges—an embodiment of the invention.

FIG. 9 shows—in a view illustrating the downward movement (M) of two panels for coupling these panels at their second pair of opposite edges—an embodiment of the invention. The edge (4) of the second pair of opposite edges (4, 5) comprising the upward-directed lower hook-shaped part (10) comprises a first vertical closing plane (34). The edge (5) of the second pair of opposite edges (4, 5) comprising the downward-directed upper hook-shaped part (11) comprises a second vertical closing plane (35). The second vertical closing plane (35) of the floor panel is provided for contacting the first vertical closing plane (34) of another such floor panel with which the floor panel is coupled at its second pair of opposite edges. In coupled condition the contact of the first vertical closing plane (34) of the floor panel with the second vertical closing plane (35) of the another such floor panel defines a closing plane. When during the downward coupling movement of the floor panel relative to the another such floor panel the distal edge of the downward-directed locking element (16) continuously contacts the proximal end of the opposing edge of the another such floor panel with which the floor panel is being coupled, at the moment the lowest point (77) of the downward-directed locking element (16) being moved downwards reaches the same height level (L) as the highest point (78) of the upward-directed locking element (13) of the another such panel, the gap (G) in horizontal direction and measured in the direction perpendicular to the second pair of opposite edges (4, 5) between the second vertical closing plane (35) of the floor panel and the first vertical closing plane (34) of the another such floor panel is less than 0.15 millimeter, preferably less than 0.1 millimeter, more preferably 0.08 millimeter. The panel edges shown in FIG. 8 are provided with bevels (71).

Figure 10:
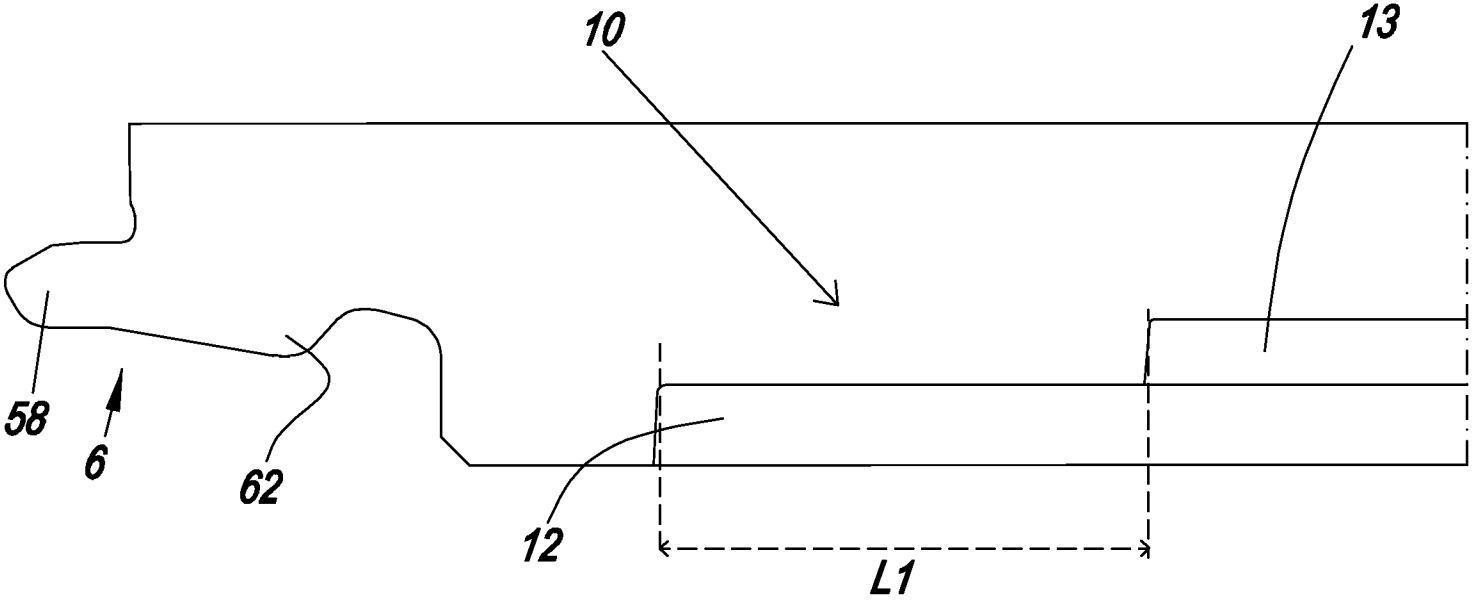
FIG. 10 illustrates an embodiment of the invention.

FIG. 10 illustrates in schematic representation an embodiment of the invention. FIG. 10 shows a view onto the edge (4) of the second pair of opposite edges comprising the upward-directed lower hook-shaped part (10) of a floor panel according to the invention. The coupling parts (6) at the first edge of the first pair of opposite edges comprise a tongue (58) and locking parts (62). Although not shown in FIG. 10, the coupling parts at the second edge of the first pair of opposite edges comprise a groove and locking parts (63). The coupling parts of the first pair of opposite edges are configured such that two of such panels can be coupled to each other at these edges by means of a turning movement, wherein a locking is established in the direction perpendicular to the plane of the so-coupled panels as well as in the direction parallel with the plane of the so-coupled panels and perpendicular to the first pair of opposite edges. Over a certain length (L1), e.g. 12 mm, extending from the first edge of the first pair of opposite edge and measured along the edge comprising the upward-directed lower hook-shaped part (10), the upward-directed lower hook-shaped part (10) consists of a lip (12) devoid of the upward-directed locking element (13).

Figure 11:
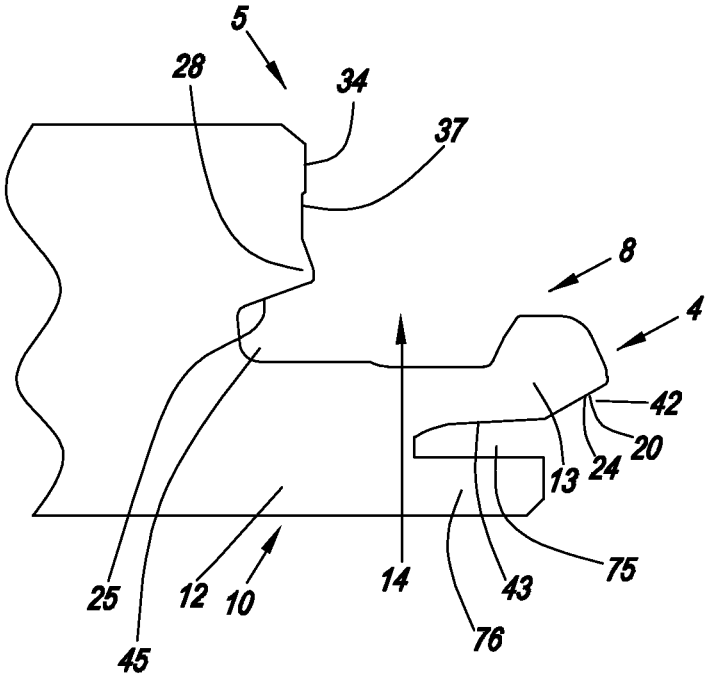
FIG. 11 illustrates a feature that can be used advantageously in panels according to the invention.

FIG. 11, in a view similar to FIG. 4, illustrates a feature that can be used in the panels according to the invention. FIG. 11 illustrates the panel edge (4) comprising the upward-directed lower hook-shaped part (10). The reference numerals of FIG. 11 have the same meaning as in the other figures. In the example of FIG. 11, the panel edge (4) comprising the upward-directed lower hook-shaped part (10) has the additional feature that the lip (12) comprises a slit (75) parallel with the surface of the panel. The slit (75) is provided to enhance the ability of the upward-directed locking element (13) to bend backwards when coupling two such panels. In the example shown in FIG. 11, the slit (75) extends in proximal direction to beyond the upward-directed locking element (13) The slit (75) is towards the back of the panel delimited by a lower lip (76). In the example shown in FIG. 11, the lower lip (76) extends distally less than the distal end of the upward-directed locking element (13). The features of FIG. 11 are of particular interest for panels comprising a substrate out of HDF (High Density Fiberboard).

The invention claimed is:

1. A floor panel for forming a floor covering, wherein the floor panel comprises a first pair of opposite edges, and a second pair of opposite edges;

wherein the first pair of opposite edges comprises coupling parts arranged so that two of said floor panels mutually can be coupled to each other;

wherein the coupling parts comprise a horizontally active locking system, wherein in a coupled condition of the two of said floor panels, effects a locking in a plane of the two of said floor panels and perpendicular to respective edges;

wherein the coupling parts also comprise a vertically active locking system, wherein in a coupled condition of the two of said floor panels, effects a locking transverse to the plane of the two of said floor panels;

wherein the coupling parts substantially are realized from a material of the floor panel; and wherein the second pair of opposite edges also comprises coupling parts on both of said opposite edges, arranged that the two of said floor panels mutually can be coupled to each other, wherein said coupling parts comprise the following characteristics:

wherein the coupling parts comprise a horizontally active locking system, wherein in a coupled condition of the two of said floor panels, effects a locking in the plane of the two of said floor panels and perpendicular to the respective edges;

wherein the coupling parts also comprise a vertically active locking system, wherein in a coupled condition of the two of said floor panels, effects a locking transverse to the plane of the two of said floor panels;

wherein the coupling parts substantially are realized from the material of the floor panel;

wherein the horizontally active locking system of the second pair of edges is formed at least of an upward-directed lower hook-shaped part situated on one of said two edges, and a downward-directed upper hook-shaped part situated on the opposite edge, wherein the upward-directed lower hook-shaped part consists of a lip with an upward-directed locking element, wherein proximally of the upward-ward directed locking element, a female part is defined as a recess, whereas the downward-directed upper hook-shaped part consists of another lip with a downward-directed locking element forming a male part;

wherein the coupling parts of the second pair of opposing edges are configured such that the two of said floor panels can be coupled to each other at the respective edges by a downward movement involving a downward snapping movement of a first floor panel of the two of said floor panels in respect to a second floor panel of the two of said floor panels;

wherein the vertically active locking system of the second pair of opposing edges comprises vertically active locking parts by respective locking surfaces, define at least a first vertical locking zone and a second vertical locking zone, wherein in coupled condition of two of said panels the first vertical locking zone is located at a distal end of the upward-directed locking element and wherein in coupled condition of two of said panels the second vertical locking zone is situated at a distal end of the downward-directed locking element;

wherein the vertically active locking parts comprise a first locking part at the edge of the panel at a proximal end of the lip of the upper hook-shaped part, a second locking part at the distal end of the downward-directed locking element, and a third locking part at a distal end of the lip of the lower hook-shaped part and a fourth locking part at a proximal end of the female part;

wherein the first and third locking part, in the coupled condition of the two of said floor panels, define said first vertical locking zone;

wherein the second and fourth locking part, in the coupled condition of the two of said floor panels, define said second vertical locking zone.

2. The floor panel according to claim 1, wherein in coupled condition at the second pair of edges of two of said floor panels, no vertical locking is provided between a proximal end of the downward-directed locking element and a proximal end of the upward-directed locking element and/or wherein the floor panel is configured such that the first vertical locking zone and the second vertical locking zone are the only zones where a vertical locking is provided in coupled condition of two of said floor panels between the edges of the second pair of opposite edges.

3. The floor panel according to claim 1, wherein the first vertical locking zone is provided at least at ⅔ of a thickness of the floor panel from the surface of the floor panel.

4. The floor panel according to claim 1, wherein an angle between a proximal end of the downward-directed locking element and the horizontal direction in a proximal direction of the upper hook-shaped part is less than 90 and/or wherein an angle between the proximal end of the upward-directed locking element and the horizontal direction in a distal direction of the lower hook-shaped part is less than 90°.

5. The floor panel according to claim 1, wherein in coupled condition at the second pair of edges of two of said floor panels, a proximal end of the downward-directed locking element contacts a proximal end of the upward-directed locking element.

6. The floor panel according to claim 1, wherein the second locking part is provided by a first undercut at the distal end of the downward-directed locking element; and wherein the fourth locking part is provided by a first protrusion at the proximal end of the female part.

7. The floor panel according to claim 6, wherein an included angle of the first protrusion is larger than an included angle of the first undercut.

8. The floor panel according to claim 6, wherein the first undercut has a triangular shape with rounded corner points.

9. The floor panel according to claim 6, wherein the first protrusion comprises two inclined outer surfaces with in between the two inclined outer surfaces a vertical surface, where an upper inclined surface is more inclined with respect to the surface of the floor panel than a lower inclined surface.

10. The floor panel according to claim 6, wherein a bottom of the first protrusion has an angle between 25° and 35° with the surface of the floor panel.

11. The floor panel according to claim 6, wherein a bottom of the first undercut has an angle between 25° and 35° with the surface of the floor panel.

12. The floor panel according to claim 6, wherein in coupled condition of two of said floor panels at the second pair of opposite edges a first space is present between the coupled opposite edges below a contact between a bottom of the first protrusion and a bottom of the first undercut and on the distal to the distal end of the downward-directed locking element and wherein the first space continues into a second space between a bottom part of the downward-directed locking element and an upper part of the lip of the lower hook-shaped part.

13. The floor panel according to claim 1, wherein the first locking part is provided by a second protrusion at the proximal end of the downward directed upper hook-shaped part; and wherein the third locking part is provided by a third undercut at the distal end of the upward-directed locking element.

14. The floor panel as in claim 13, wherein an upper surface of the second protrusion has an angle between 1° and 20° with the surface of the floor panel.

15. The floor panel as in claim 13, wherein an angle with the surface of the floor panel of an upper surface of the third undercut is between 5 and 15°.

16. The floor panel as in claim 13, wherein a first angle with the surface of the floor panel of an upper surface of the third undercut is smaller than a second angle with the surface of the floor panel of an upper surface of the second protrusion; a difference between the first and second angles is at least 5°.

17. The floor panel as in claim 1, wherein a first vertical closing plane is provided at the edge of the second pair of opposite edges comprising the upward-directed lower hook-shaped part, wherein the first vertical closing plane is provided for making contact in coupled condition of two of said floor panels with a second vertical closing plane of the corresponding edge of the coupled panel;

wherein a ratio of a horizontal distance between the first vertical closing plane and the distal end of the lip comprising the upward-directed locking element over a thickness of the floor panel is less than 1.1.

18. The floor panel according to claim 1, wherein the second vertical locking zone is provided in a bottom half of a thickness of the floor panel.

19. A floor panel as in claim 1, wherein the edge of the second pair of opposite edges comprising the upward-directed lower hook-shaped part comprises a first vertical closing plane;

wherein the edge of the second pair of opposite edges comprising the downward-directed upper hook-shaped part comprises a second vertical closing plane;

wherein the second vertical closing plane of the floor panel is provided for contacting the first vertical closing plane of another of said floor panel wherein the floor panel is coupled at its second pair of opposite edges, wherein in coupled condition a contact of the first vertical closing plane of the floor panel with the second vertical closing plane of the another of said floor panel defines a closing plane;

wherein when during the downward coupling of the floor panel relative to the another of said floor panel a distal edge of the downward-directed locking element continuously contacts the proximal end of the opposing edge of the another of said floor panel wherein the floor panel is being coupled, at a moment the lowest point of the downward-directed locking element being moved downwards reaches the same height level as the highest point of the upward-directed locking element of the another of said panel, a gap in a horizontal direction and measured in a direction perpendicular to the second pair of opposite edges between the second vertical closing plane of the floor panel and the first vertical closing plane of the another of said floor panel is less than 0.15 millimeter.

20. The floor panel as in claim 1, wherein the lip of the upward-directed lower hook-shaped part comprises a slit parallel with the surface of the panel and wherein the slit is towards a back of the panel delimited by a lower lip; and wherein the lower lip extends distally less than the distal end of the upward-directed locking element.

* * * * *